US011647819B2

(12) United States Patent
Mody et al.

(10) Patent No.: US 11,647,819 B2
(45) Date of Patent: May 16, 2023

(54) TENSION SPRING ASSISTED PROTECTIVE COVER

(71) Applicant: CASE-MATE, INC., Atlanta, GA (US)

(72) Inventors: Saumil Chetan Mody, Atlanta, GA (US); Jianzhi Chen, Cumming, GA (US); Cole Dobson, Dunwoody, GA (US)

(73) Assignee: CASE-MATE, INC., Atlanta, GA (US)

( * ) Notice: Subject to any disclaimer, the term of this patent is extended or adjusted under 35 U.S.C. 154(b) by 0 days.

(21) Appl. No.: 17/385,868

(22) Filed: Jul. 26, 2021

(65) Prior Publication Data

US 2021/0393008 A1 Dec. 23, 2021

Related U.S. Application Data

(63) Continuation-in-part of application No. 16/743,562, filed on Jan. 15, 2020, now Pat. No. 11,116,300.

(60) Provisional application No. 62/794,443, filed on Jan. 18, 2019.

(51) Int. Cl.
*A45C 11/00* (2006.01)
*A45C 13/00* (2006.01)

(52) U.S. Cl.
CPC ..... *A45C 11/00* (2013.01); *A45C 13/007* (2013.01); *A45C 2011/001* (2013.01); *A45C 2011/002* (2013.01); *A45C 2011/003* (2013.01)

(58) Field of Classification Search
CPC . A45C 13/007; A45C 11/00; A45C 2011/001; A45C 2011/002; A45C 2011/003
See application file for complete search history.

(56) References Cited

U.S. PATENT DOCUMENTS

| | | | |
|---|---|---|---|
| 4,984,706 | A | 1/1991 | Cadwell et al. |
| 10,064,298 | B2 | 8/2018 | Cavenagh et al. |
| 2007/0227923 | A1 | 10/2007 | Kidakarn |
| 2008/0083631 | A1 | 4/2008 | Tsang et al. |
| 2009/0233658 | A1 | 9/2009 | Murayama et al. |
| 2014/0290009 | A1 | 10/2014 | Kasai et al. |
| 2016/0234951 | A1 | 8/2016 | Chen et al. |
| 2018/0295736 | A1 | 10/2018 | Cavenagh et al. |

OTHER PUBLICATIONS

Case-Mate ATT010925 Pantech Breeze II Tough Case; 2011; 1 pg.

*Primary Examiner* — Corey N Skurdal
(74) *Attorney, Agent, or Firm* — Gardner Groff & Greenwald, PC

(57) ABSTRACT

A protective and/or ornamental case for a foldable handheld electronic device. The case includes a front shell and a back shell pivotally connected to a hinge cover by one or more coupling mechanisms. A first portion of an electronic device is inserted into the front shell and a second portion of the electronic device is inserted into the back shell. The coupling mechanisms retain the front and back shells operatively engaged with the hinge cover as the electronic device housed in the case is pivotally or hingedly opened and closed, help prevent unintended opening or closing of the device, and keep the device open or closed when so positioned by a user.

18 Claims, 9 Drawing Sheets

TENSION SPRING ASSISTED PROTECTIVE COVER

CROSS-REFERENCE TO RELATED APPLICATIONS

This application is a continuation-in-part of U.S. Non-Provisional patent application Ser. No. 16/743,562 filed Jan. 15, 2020, which claims the benefit of U.S. Provisional Patent Application Ser. No. 62/794,443 filed Jan. 18, 2019, the entireties of which are hereby incorporated herein by reference for all purposes.

TECHNICAL FIELD

The present invention relates generally to the field of protective covers for electronic devices, and more particularly to a tension spring assisted foldable protective cover for a portable foldable electronic device.

BACKGROUND

Protective and/or decorative cases are used in connection with portable electronic devices such as cell phones, smart phones, electronic readers, handheld game devices and the like. It is to the provision of a tension spring assisted folding protective cover for a foldable portable electronic device that the present invention is primarily directed.

SUMMARY

In example embodiments, the present invention provides a tension spring assisted protective cover for a portable foldable electronic device having a first housing and a second housing. The case comprises two jackets or shells coupled by a plurality of tension coupling mechanisms or spring coupling elements to a hinge cover shell, wherein a first shell is configured to receive the first housing of the electronic device and a second shell is configured to receive the second housing of the electronic device. The first and second shells generally comprise a back or base panel and a sidewall or frame extending substantially about the periphery of the base panel. The first and second shells further comprise one or more holding posts or members located on the exterior surface of the top and bottom sidewalls and extending externally therefrom. The hinge cover shell further comprises a plurality of holding posts or members located on the exterior surface of the top and bottom ends and extending externally therefrom. The holding posts are configured to receive the tension coupling mechanisms wherein one end of a first tension coupling mechanism is connected to one holding post of the front shell by means of a first engagement feature and the other end of the first tension coupling mechanism is connected to a first holding post of the hinge cover shell. Similarly, one end of a second tension coupling mechanism is connected to one holding post of the back shell by means of a second engagement feature and the other end of the second tension coupling mechanism is connected to a second holding post of the hinge cover shell.

In one aspect, the present invention relates to a cover for a foldable electronic device including a plurality of tension coupling mechanisms to assist the user keep the device in fully open or fully closed positions when intended, and to prevent unintended opening or closing of the device.

In another aspect, the invention relates to a case for a foldable electronic device, the case including a front or first shell having a rigid back panel and a peripheral frame. One or more holding posts preferably protrude externally from the exterior surface of the peripheral frame. The case further includes a back or second shell having a rigid back panel and a peripheral frame of the first shell. One or more holding posts preferably protrude externally from the exterior surface of the peripheral frame of the second shell. The case further includes a hinge cover or third shell having a rigid, elongate, semi-tubular body. One or more pairs of holding posts preferably protrude externally from at least one end of the of hinge cover shell. The case preferably further includes a plurality of coupling mechanisms, wherein one end of a first tension mechanism is connected to the holding post of the front shell by means of a first engagement feature and the other end of the first tension mechanism is connected to at least one of the pair of holding posts on the hinge cover shell by means of a second engagement feature of the first tension mechanism, and wherein one end of a second tension mechanism is connected to the holding post of the back shell by means of a first engagement feature and the other end of the second tension mechanism is connected to at least one other holding posts on the hinge cover shell In still another aspect, the invention relates to a case for a foldable electronic device, the case including a front shell, a back shell, and a protective shell for the device's hinge. The hinge protection shell includes semi-tubular body with a closed top end and a closed bottom end. In example embodiments, a plurality of coupling mechanisms retain the first and second shells operatively engaged with the hinge protection shell to allow a pivotal folding movement of the front and back shells upon opening and closing of the device housed in the case.

In another aspect, the invention relates to a foldable case for at least partially housing a foldable electronic device. The foldable electronic device preferably has a first device portion, a second device portion, and a hinged device coupling between the first and second device portions allowing a pivotal range of motion between the first and second device portions. The foldable case preferably includes a first case portion configured to at least partially house the first device portion when the case is installed on the device, a second case portion configured to at least partially house the second device portion when the case is installed on the device, a third case portion configured to at least partially house the hinged device coupling, and engagement means between the first and second case portions and the third case portion. The engagement means preferably maintains a biasing force between the first and third case portions and between the second and third case portions, and further retains the first and second case portions in operative engagement with the third case portion through the pivotal range of motion when the case is installed on the device.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

Figure 2:
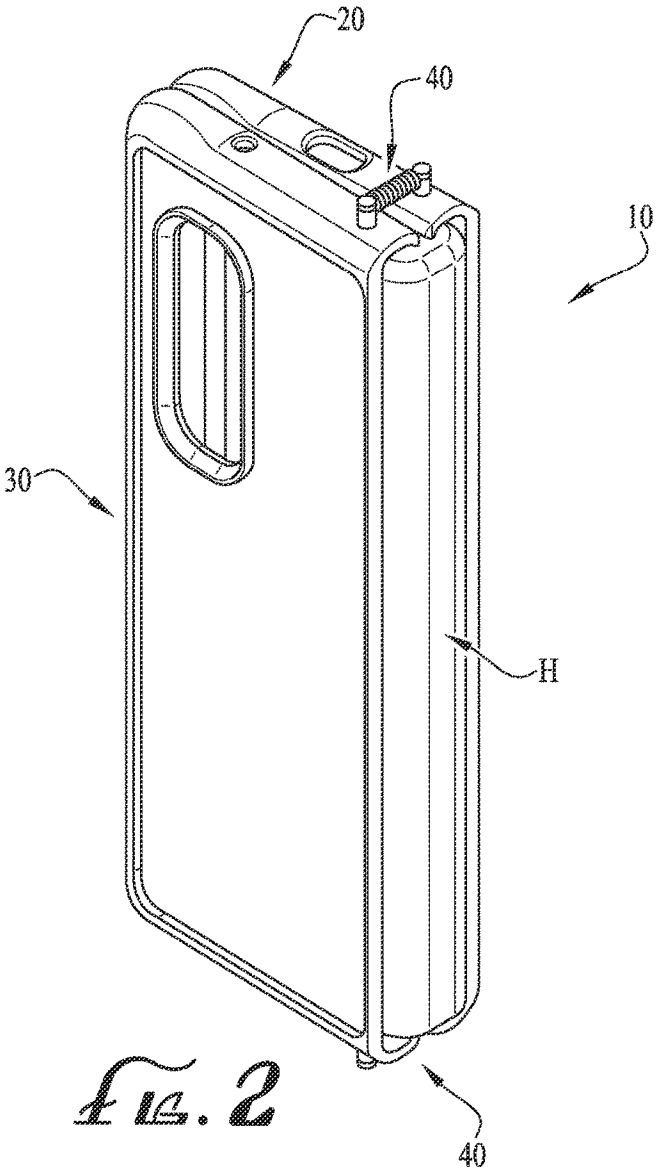
FIG. 2 is a perspective view of the cover of FIG. 1 in a closed position.

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-4 show a foldable protective case or cover 10 for a foldable portable electronic device D, according to an example embodiment of the present invention. In the depicted embodiment, the case or cover 10 includes a housing for receiving and at least partially covering the foldable electronic device. In example embodiments, the case or cover 10 is configured to fit a foldable smart-phone, tablet computer, cell phone, MP3 player, music and/or video player, electronic reader, handheld game device, or other foldable portable electronic device. Case 10 generally comprises a first or front jacket or shell 20, a second or back jacket or shell 30, and one or more tension or spring mechanisms 40 operatively engaged between the front and back shells. In example forms, the front and back jackets 20, 30 are at least partially formed of polycarbonate or other hard plastic, metal, composite, polymeric, ceramic, and/or other material(s) of construction.

Figure 1:
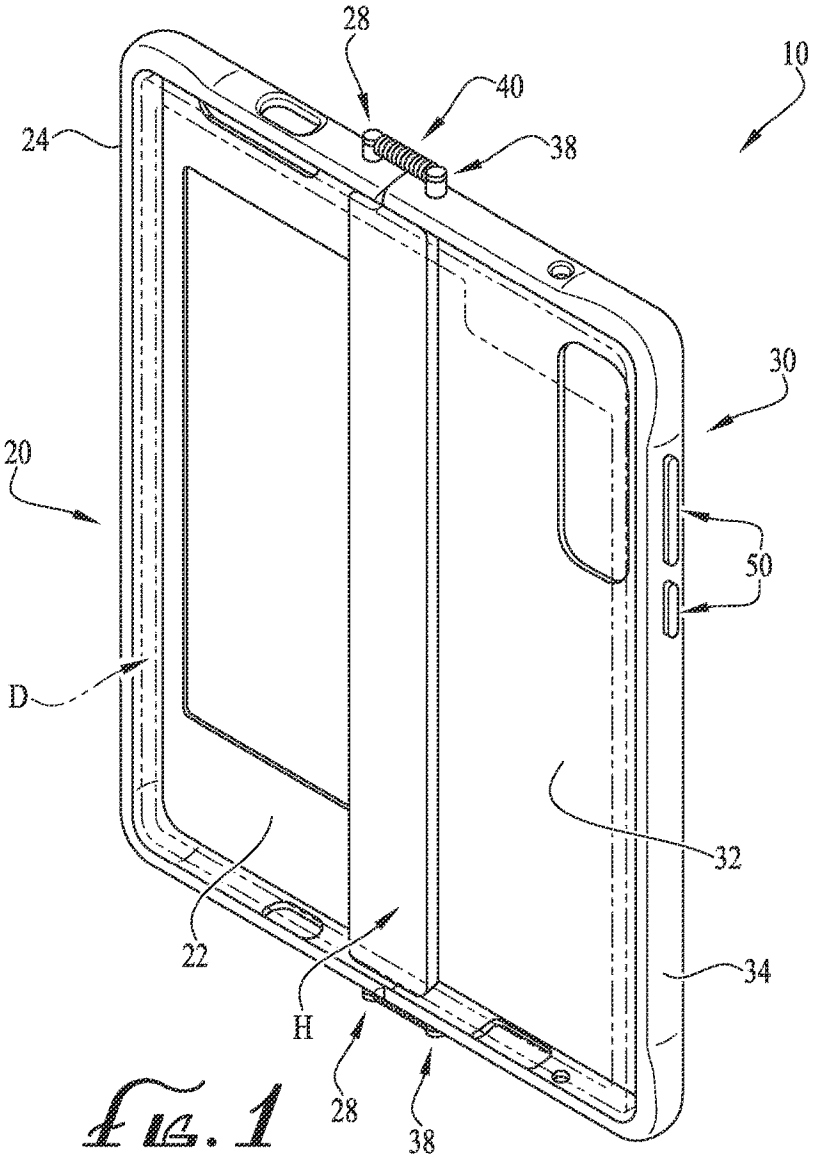
FIG. 1 is a perspective view of a tension spring assisted protective cover or case for a foldable portable electronic device in an open position, according to an example embodiment of the present invention.

As shown in FIG. 1, the front shell 20 generally comprises a front plate or base panel 22 and a raised sidewall 24. In the depicted embodiment, the sidewall 24 projects transversely outward along the top edge, the bottom edge, and a first or outer side edge of the base 22, forming a continuous sidewall 24 with two radiused corners partially bounding an interior chamber for receiving an electronic device. The sidewall 24 preferably comprises a ridge or flange along its perimeter at its distal rim that extends inwards towards the center of the shell 20 to help retain the case on an electronic device. In the depicted embodiment, the front base panel 22 is generally flat and generally rectangular with rounded corners, but in alternate embodiments may comprise different configurations to match the shape of a particular electronic device for which the case is configured. In yet other embodiments, the sidewall 24 comprises two or more separate sidewalls extending from discrete sections of the base periphery resulting in a plurality of discrete sidewalls.

Figure 4:
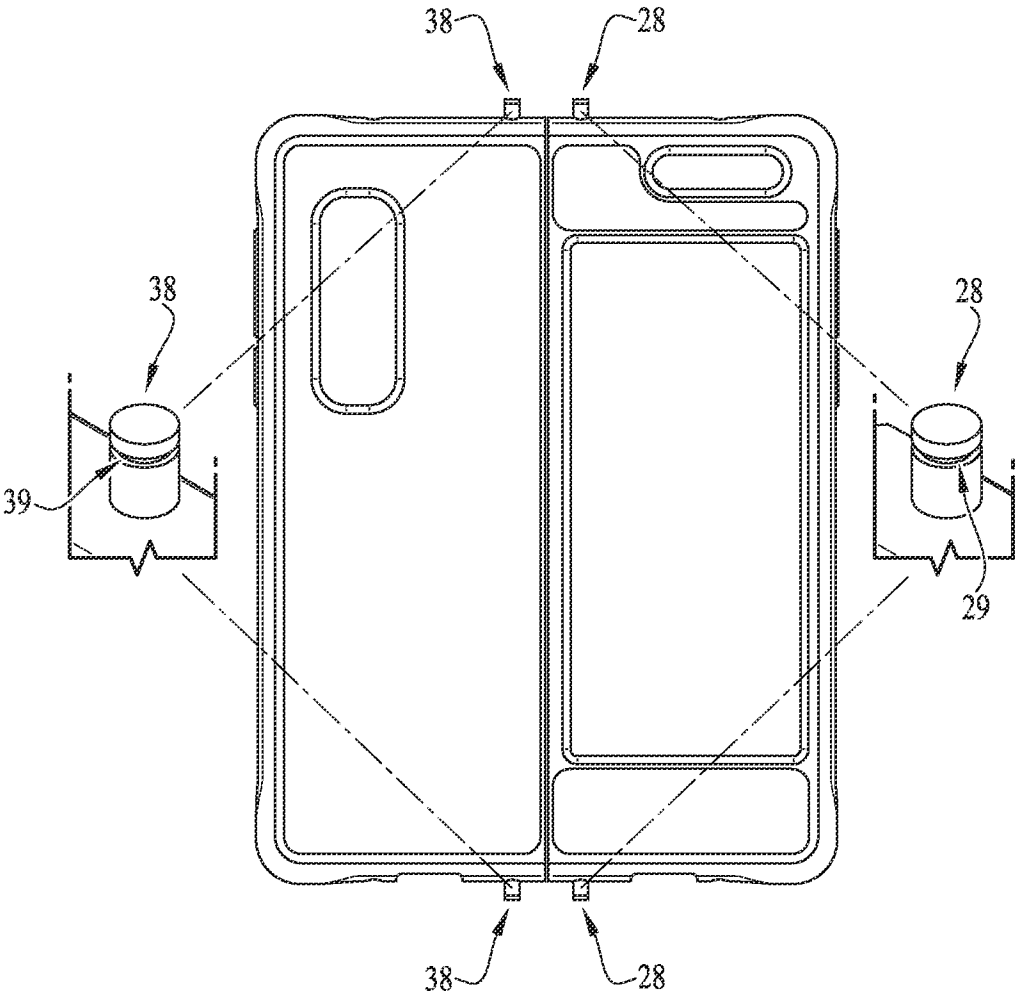
FIG. 4 is a back view of the cover of FIG. 1 and shows detail views of holding posts on the exterior of the cover.

The front shell 20 further comprises one or more biasing element retainers or retention elements, for example in the form of holding posts or support members 28, as shown in FIGS. 1 and 4. In alternate embodiments, the biasing element retainers may be in the form of a recess, projection or other surface feature, and/or a coupling, connector or other attachment means, for coupling a spring or other biasing element to the front shell 20. In the depicted embodiment, one holding post 28 is located on the top sidewall of jacket 20 and extends externally therefrom. A second holding post 28 is located on the bottom sidewall of jacket 20 and extends externally therefrom. The two posts 28 are preferably located near the side of base 22 opposite the first side edge. The posts 28 further comprise a groove or channel 29 along the perimetric surface, as shown in the detail view of FIG. 4. In the depicted embodiment, the posts 29 comprise a cylindrical shape or a circular cross-section; however, the cross-sectional shape of posts 28 can comprise of various geometric shapes, such as for example, rectangle, triangle, star, and the like.

The back shell 30 generally comprises a back plate or base panel 32 and a raised sidewall 34. In the depicted embodiment, the sidewall 34 projects transversely outward along the top edge, the bottom edge, and a first side edge of the base 32, forming a continuous sidewall 34 with two radiused corners partially bounding an interior chamber for receiving the electronic device. The sidewall 34 preferably comprises a ridge or flange along its perimeter at its distal rim that extends inwards towards the center of the shell 30 to retain the case in place on an electronic device. Back base 32 is generally flat and rectangular with rounded corners, but it may comprise different configurations to match the shape of a particular electronic device in alternate embodiments. In yet other embodiments, the sidewall 34 comprises two or more separate sidewalls extending from discrete sections of the base periphery resulting in a plurality of discrete sidewalls.

The back shell 30 further comprises one or more biasing element retainers or retention elements, for example in the form of holding posts or support members 38, as shown in FIGS. 1 and 4. In alternate embodiments, the biasing element retainers may be in the form of a recess, projection or other surface feature, and/or a coupling, connector or other attachment means, for coupling a spring or other biasing element to the front shell 30. In the depicted embodiment, one holding post 38 is located on the top sidewall of jacket 30 and extends externally therefrom. A second holding post 38 is located on the bottom sidewall of jacket 30 and extends externally therefrom. The two posts 38 are preferably located near the side of base 32 opposite the first side edge. The posts 38 further comprise a groove or channel 39 along the perimetric surface, as shown in the detail view of FIG. 4. In the depicted embodiment, posts 38 comprise a cylindrical shape or a circular cross-section; however, the cross-sectional shape of posts 38 can comprise various geometric shapes, such as for example, rectangle, triangle, star, and the like.

Figure 3:
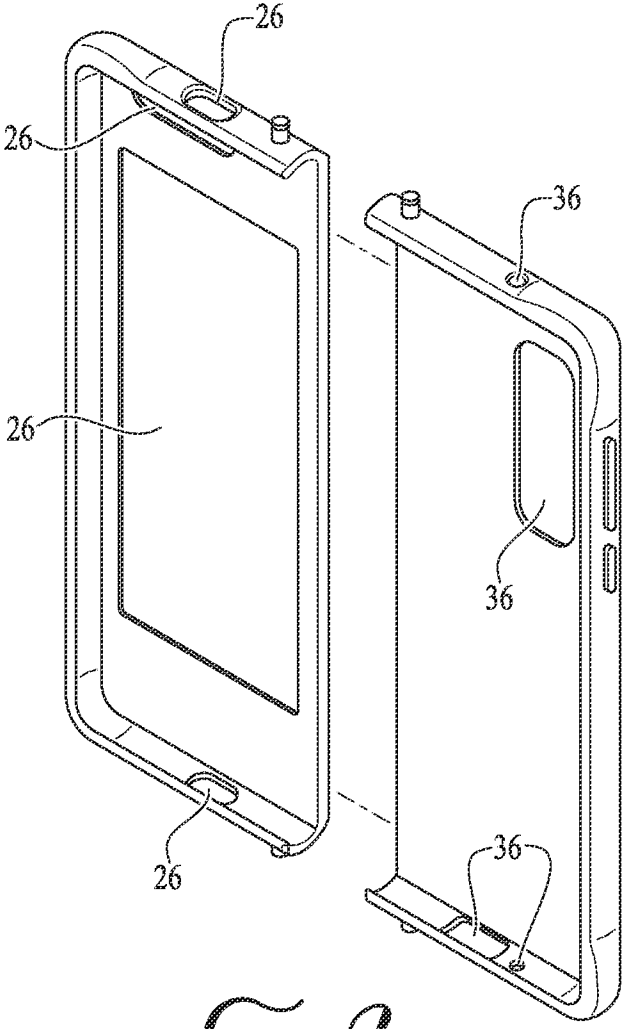
FIG. 3 is a perspective assembly view of the front and back cover shells of the cover of FIG. 1.

The front and back bases 22, 32 and sidewalls 24, 34 optionally include one or more cutouts or apertures 26 and 36 extending therethrough, as shown in FIG. 3. Apertures 26 and 36 are positioned such that buttons, switches, ports, touch-screen(s), camera lenses, microphones, and/or other user interfaces or mechanisms on an electronic device installed into the case 10 can be accessed and operated therethrough.

The front and/or back shells 20, 30 can additionally include one or more buttons 50 positioned in the cutouts of the shells, as shown in FIG. 1, wherein the buttons 50 are configured to engage buttons on the device such as the volume controls and power button. The buttons 50 can include a T-shaped retaining feature configured to engage a flange on the front and back shells to keep the buttons 50 engaged with the shells. In the example embodiments, buttons 50 are formed of polycarbonate or other injection molded material.

Figure 8:
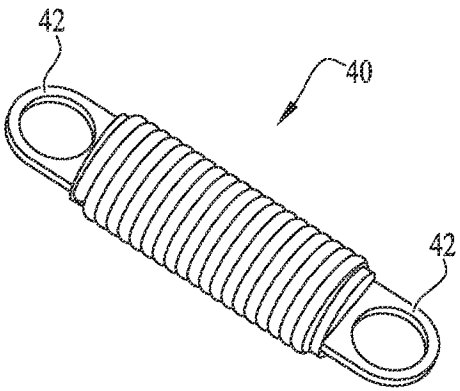
FIG. 8 is a perspective view of a tension spring according to an example embodiment.
Figure 7:
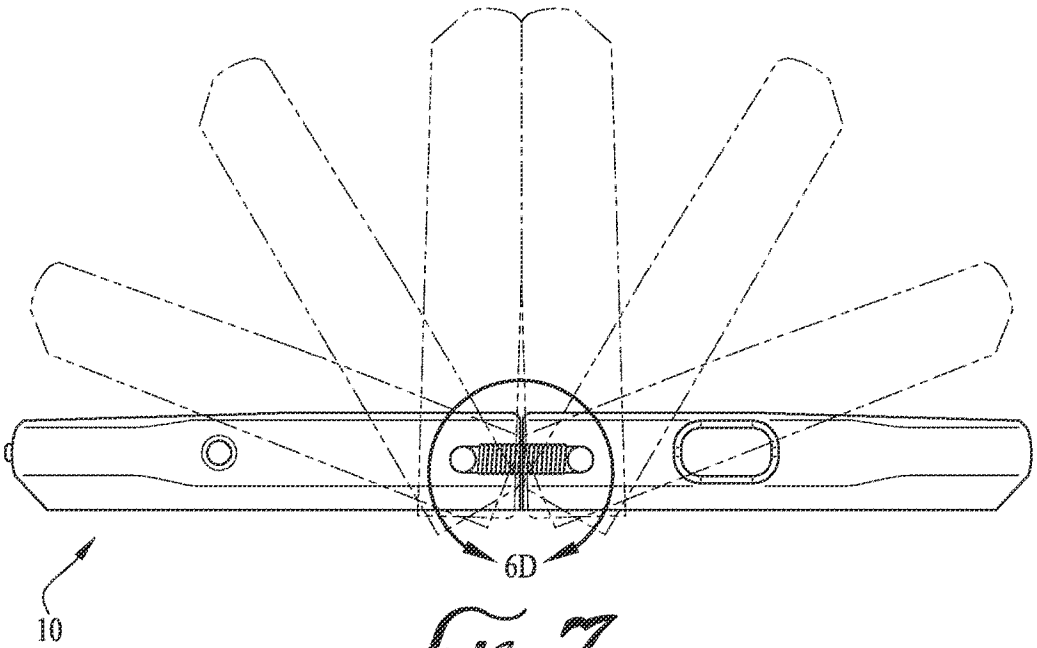
FIG. 7 shows the relative positions of the front and back shells of FIG. 3 in a fully open, semi-open, semi-closed, and fully closed position.

In example embodiments, one or more biasing elements or engagement means such as tension or spring mechanisms 40 are installed on the case 10 by securing a first distal end of the tension mechanism to one support post 28 on the front shell 20 and securing a second distal end of the tension mechanism to a support post 38 on the back shell 30. In the depicted embodiments, the biasing elements or tension mechanisms 40 are tension springs, as shown in FIG. 8. The first and second distal ends of the tension springs comprise engagement features 42 in the form of a loop or ring. In alternate embodiments, the biasing elements or engagement means may comprise an elastic cord, band, strip, living hinge and/or other elastically resilient member, a helical, coil, torsion, leaf or other form of extension or compression spring, one or more magnetic and/or magnetically-attracted elements, a gravity-assisted or manual closure mechanism, and/or other form of biasing or engagement means. In yet other embodiments, engagement features 42 are in the form of hooks and/or clips. In further alternate embodiments, the ends of the spring or other tension member engage within recesses or other retention elements or engagement features on the front and back shells, or are secured by adhesive, fasteners or other attachment means.

The springs or other tension mechanisms 40 are installed onto case 10, connecting together the front and back shells 20, 30 via support posts 28, 38. Engagement feature 42 of the first distal end of spring mechanism 40 is fitted over groove 29 of support post 28. Engagement feature 42 of the second distal end of spring mechanism 40 is fitted over groove 39 of the support post 38. According to example embodiments, loop 42 at the first distal end of tension spring 40 is contoured over support post 28 and nestled into groove 29. Similarly, loop 42 at second distal end of tension spring 40 is contoured over support post 38 and adjusted to fit securely in groove 39. In the depicted embodiments, one tension spring 40 with loop features 42 is connected to holding posts 28 and 38 located on top sidewalls 24 and 34 of front and back shells 20, 30, and a second tension spring 40 is connected to holding posts 28 and 38 located on the bottom sidewalls 24 and 34 of the front and back shells 20, 30. In alternate embodiments, a single biasing spring 40 may be provided at either the top or the bottom of the case 10, and a pivotal hinge mechanism at the other of the top or bottom of the case.

In use, the user installs the case 10 onto a foldable electronic device having a first housing and a second housing, where the first housing and the second housing are connected by a hinge element H. The user installs the front shell 20 onto the device's first housing and the back shell 30 onto the second housing of the device. In an example method of use, the first housing of a foldable electronic device is inserted into front shell 20 such that the exterior of the first housing fits snugly within the sidewall 24 and front panel 22. The flange of sidewall 24 helps retain the device within shell 20. Similarly, the second housing of the device is inserted into the back shell 30 such that the exterior of the second housing fits snugly between sidewall 34 and back panel 32, and the second housing is further retained by the flange of sidewall 34. The hinge or fulcrum geometry of the case 10 generally corresponds to the hinge or fulcrum geometry of the folding electronic device intended to be housed in the case, whereby the relative pivotal or folding movement of the case shells 20, 30 substantially matches the relative pivotal or folding movement of the corresponding folding elements of the device for smooth operation and closely conforming fit.

In example embodiments, a foldable electronic device is generally capable of pivotal movement through a range of motion including the depicted four relative positions—fully closed, semi-closed, semi-open, and fully open—as shown in FIGS. 5A-D and FIG. 7. FIGS. 6A-D show detail views of tension mechanism 40 in the four positions collectively shown in FIG. 7, and depict a sequence of opening (FIGS. 5A to 5D and FIGS. 6A to 6D) and closing (FIGS. 5D to 5A and FIGS. 6D to 6A) the device within the case or cover 10 according to example methods of use.

Figures 5A, 5B, 5C, 5D:
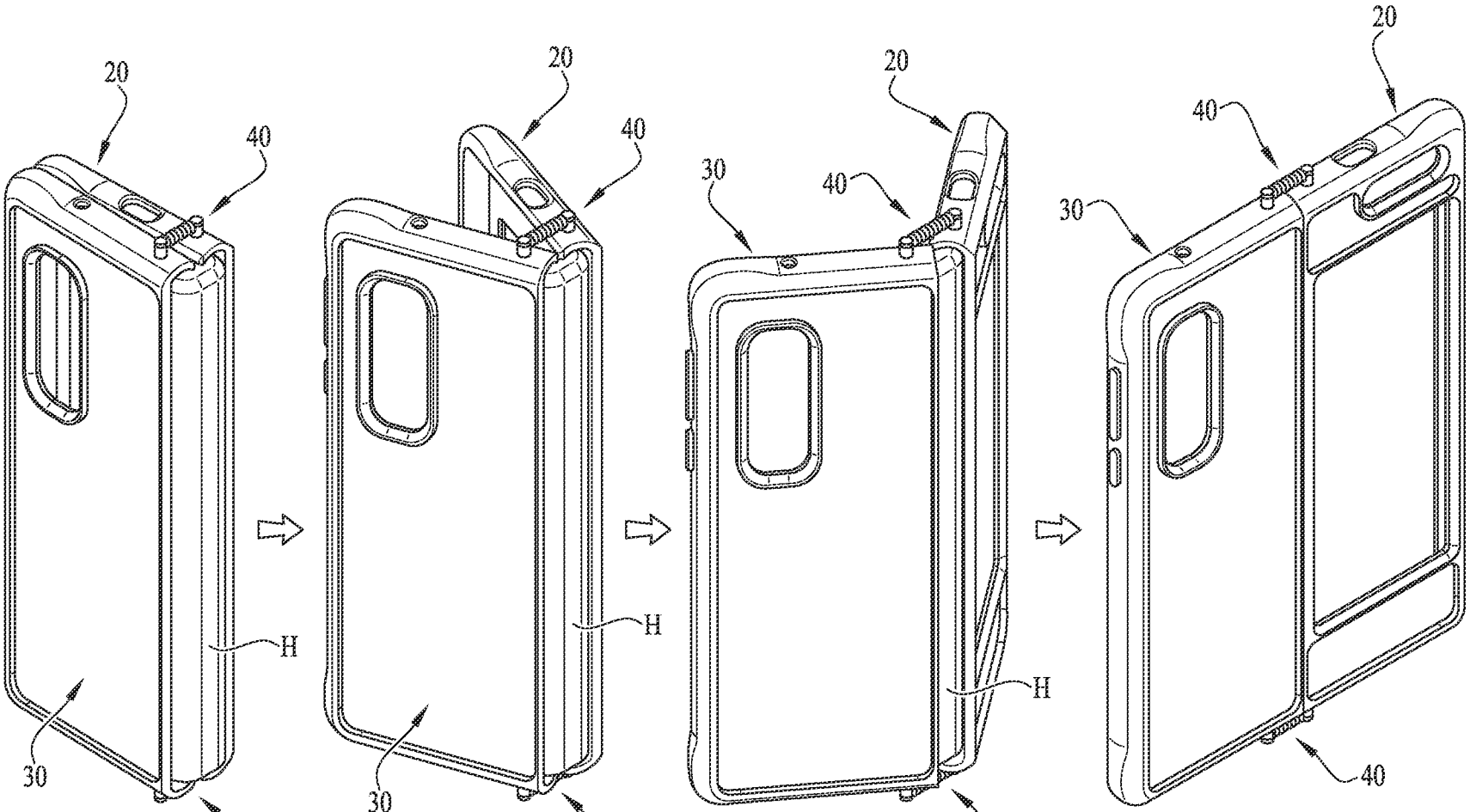
FIGS. 5A-5D show a sequence of operation of a cover according to an example embodiment, moving from a closed configuration to an open configuration.
Figure 6A:
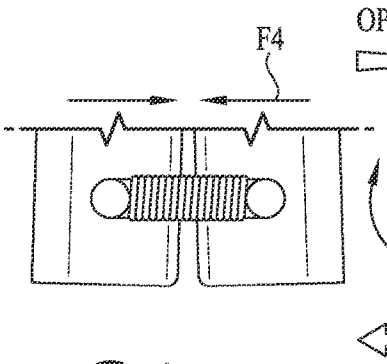
FIGS. 6A-6D show additional detail of the tension spring and forces applied on the cover shells, according to an example embodiment, as the cover moves from a closed configuration to an open configuration.
Figure 6B:
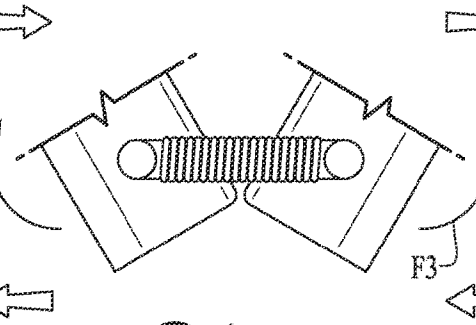
Figure 6C:
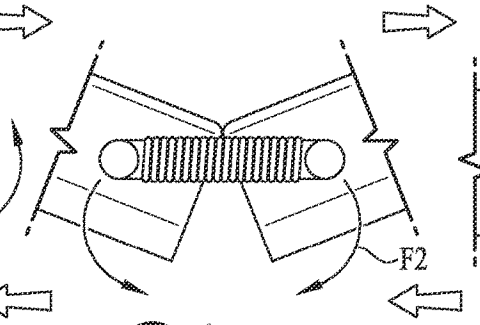

In an example method of use, spring 40 is under tension when the case and electronic device are in a fully closed position (FIGS. 5A, 6A). The tensional load on spring 40 biases the case 10 toward the fully closed position, and resists external forces to spread apart the top and bottom shells 20, 30 rotationally about a fulcrum point fixed by the device's hinge. As the user applies greater force and overcomes the resistance, the front and back shells 20, 30 spread apart about the device's hinge. As the angle between the front and back shells 20, 30 increase (FIGS. 5B, 5C and FIGS. 6B, 6C), the location of the tensional force between holding posts 28 and 29 moves relative to the fulcrum points 25, 35 and determines the direction of the resulting rotation, as shown in FIG. 9.

Figure 6D:
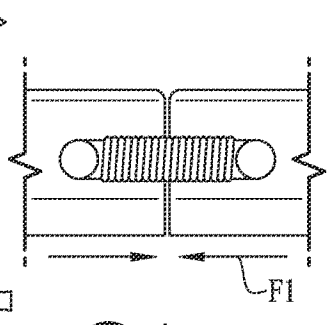
Figure 9:
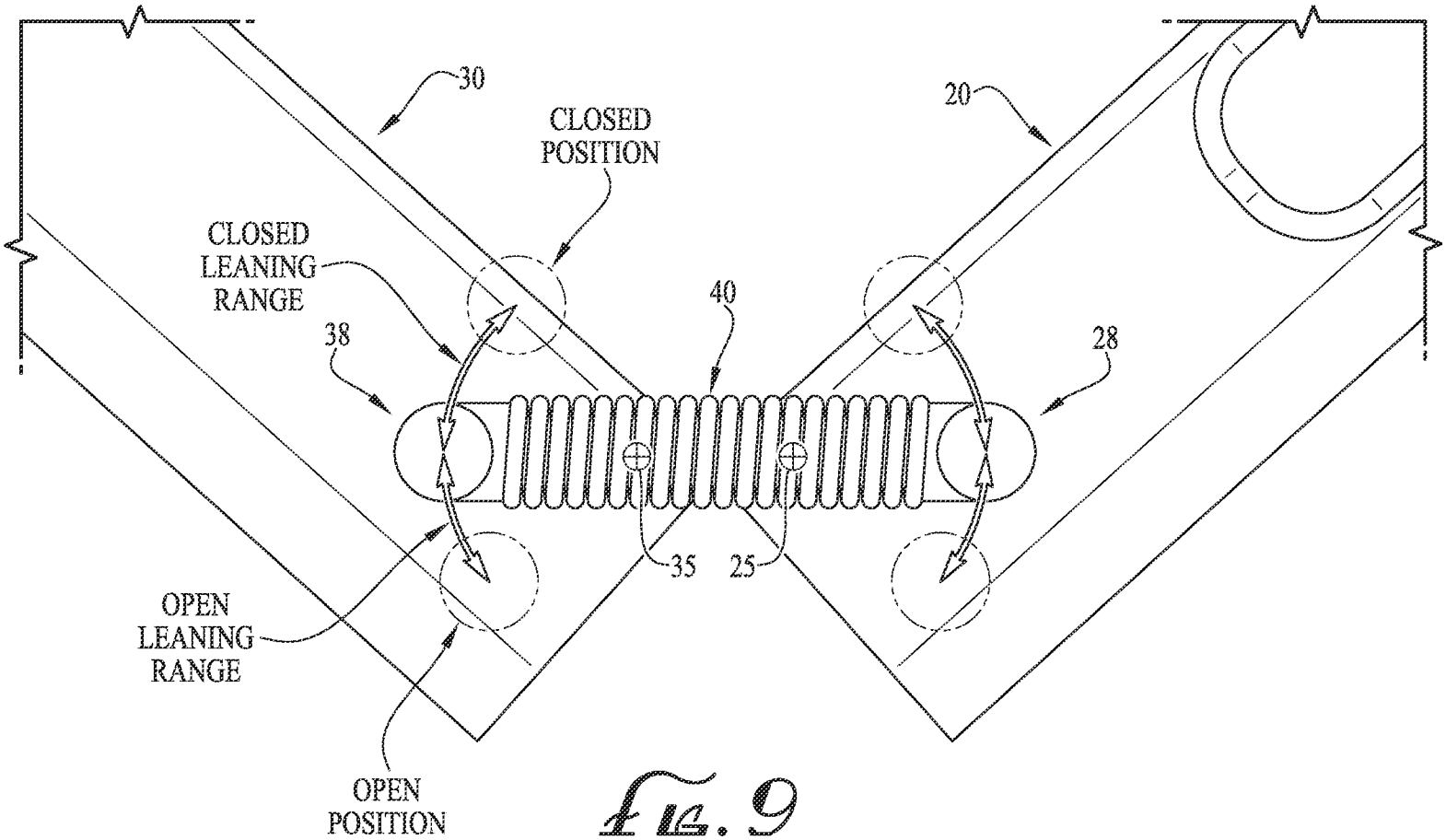
FIG. 9 shows the relative positions of holding posts and the associated fulcrum points in a fully open, semi-open, semi-closed, and fully closed position.

A semi-closed position, as shown in FIG. 9, refers to any configuration of case 10 where the tensional force vector or line is above or forward of a line extending through the fulcrum points 25, 35 of the shells 20, 30 as the shells rotate or pivot relative to one another along an opening and/or closing range of motion constrained by the device's fixed hinge. In a semi-closed position, the tension in the spring will cause rotation of the top and bottom shells to return the case to a fully closed position. A semi-open position refers to any configuration of case 10 where the spring mechanism is below or behind the fulcrum points 25, 35, as depicted in FIG. 9. In a semi-open position, the tension in the spring will apply a force to both top and bottom shells causing rotation about their respective fulcrum points 25, 35 to bias the device toward the fully open position (FIGS. 5D, 6D).

Figure 11B:
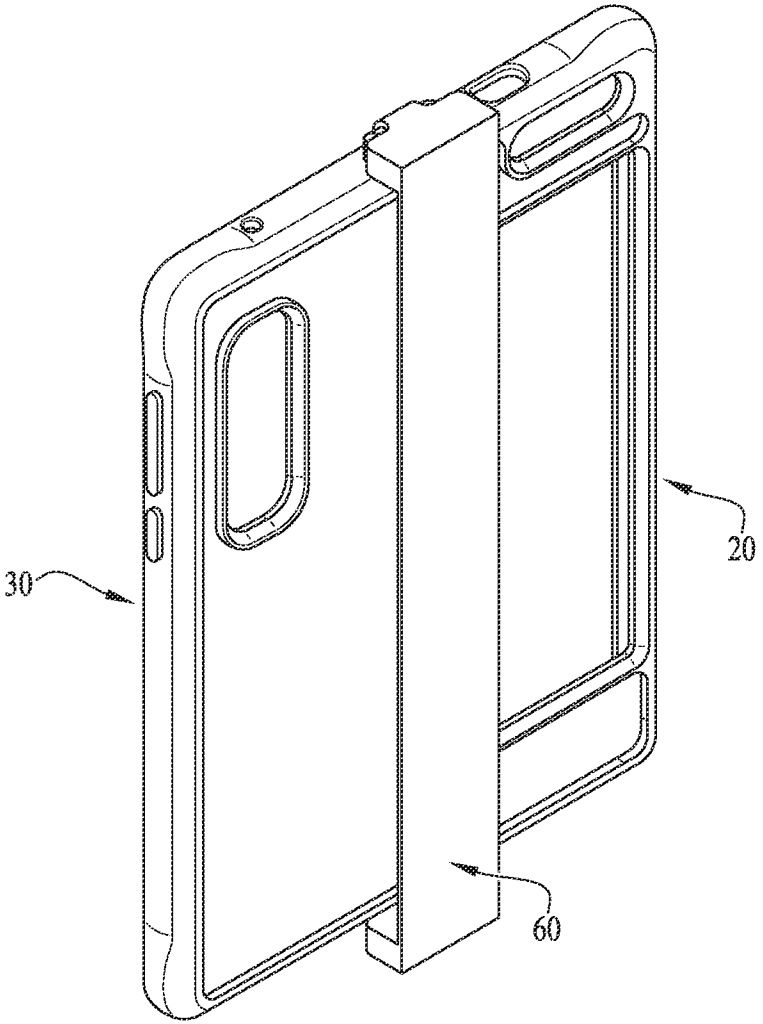
FIG. 11B shows the hinge cover plate of FIG. 10 attached to the cover of FIG. 1 in a fully open position.
Figure 11A:
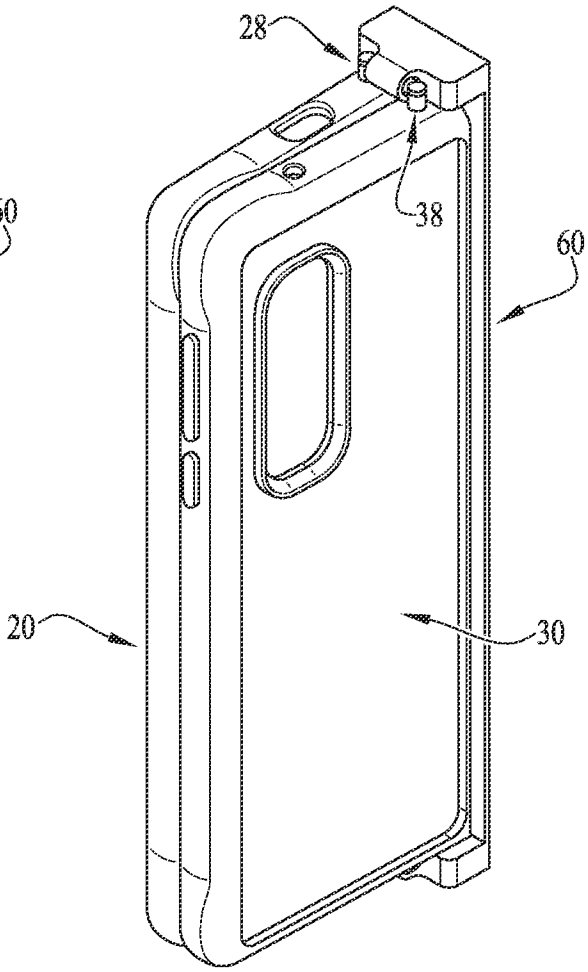
FIG. 11A shows the hinge cover plate of FIG. 10 attached to the cover of FIG. 1 in a fully closed position.
Figure 10:
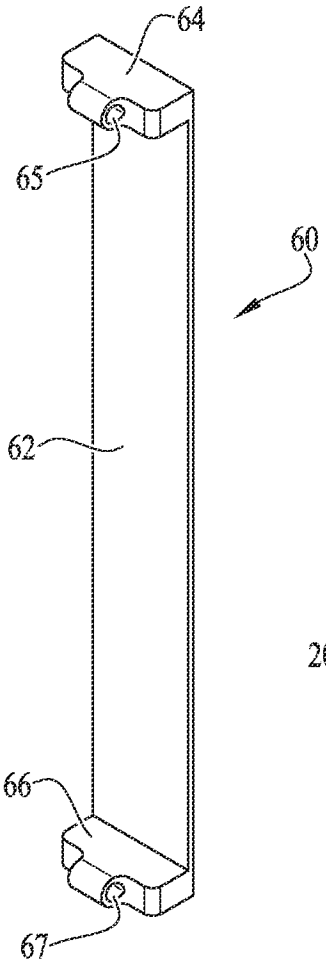
FIG. 10 is a perspective view of an optional hinge cover plate.

In further example embodiments of the present invention, the case 10 optionally comprises an hinge protection plate or panel 60, as shown in FIGS. 10 and 11. According to example embodiments, the hinge protection panel 60, when provided, comprises a generally flat base 62 with a top end and a bottom end. A top wall or frame 64 extends transversely from the top end of the base and includes a top bore or channel 65 for containing or covering the upper spring 40 or biasing element. Similarly, a bottom wall or frame 66 extends transversely from the bottom end of the base and includes a bottom bore or channel 67 for containing or covering the lower spring 40 or biasing element. In example embodiments, as shown in FIGS. 11A-B, the hinge protection panel 60 is configured such that the top bore 65 aligns concentrically with spring 40 between the holding posts 28 and 38 on the top ends of front and back shells 20, 30 and the bottom bore 67 aligns concentrically with spring 40 between holding posts 28 and 38 on the bottom ends of the front and back shells 20, 30. In this manner, spring(s) 40 engaged between engagement posts at the top and/or bottom of the first and second shells 20, 30 extend through the respective top and/or bottom channels 65, 67 to retain and bias the first and second shells, while shielding against user contact with the spring(s) and at potential pinch points between the shells.

In example embodiments, the first and second shells, and the hinge protection plate can be formed from polycarbonate or other hard plastics, thermoplastic polyurethane or other soft plastics, metal, composite, ceramic, and/or other material(s) of construction. In particular embodiments, the components of the case 10 optionally comprises a hard and durable outer shell for impact resistance, for example comprising polycarbonate (PC) or other hard plastic; and a softer cushioning inner layer or lining, for example comprising thermoplastic polyurethane (TPU) for shock absorption, to provide improved protection to the electronic device housed in the case. In further example embodiments, the case optionally also comprises an inner frame or wall that conforms to the inner surfaces of sidewalls 24 and 34. The inner frame preferably comprises a resilient or compressible material such as silicon, rubber, elastomer or the like, to cushion the electronic device from impacts and assist in retaining the case or cover in place on an electronic device contained therein.

Figure 13:
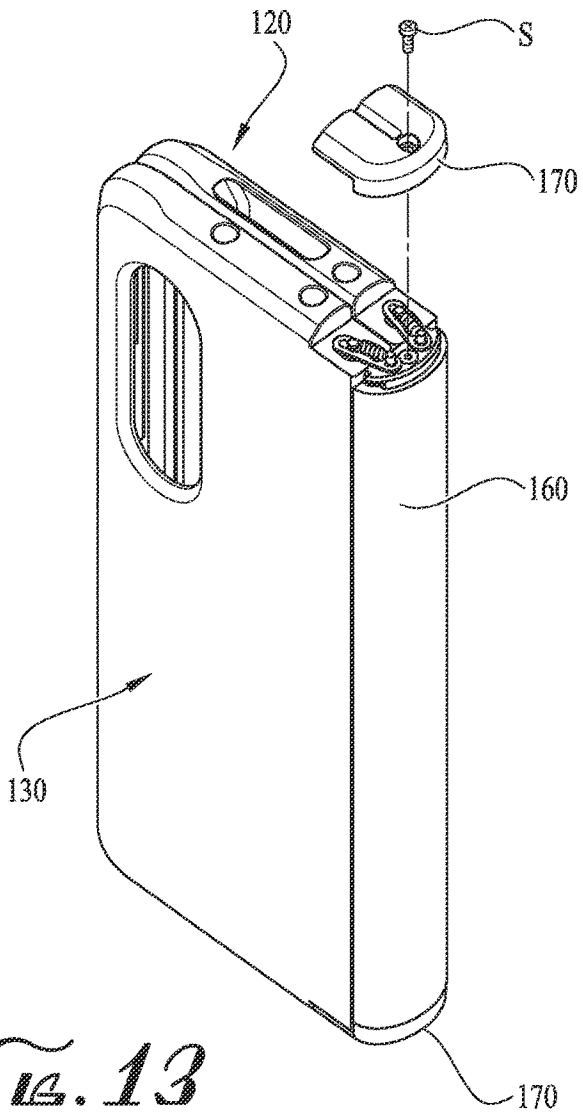
FIG. 13 is a perspective view of the cover of FIG. 12 in a closed position.
Figure 12:
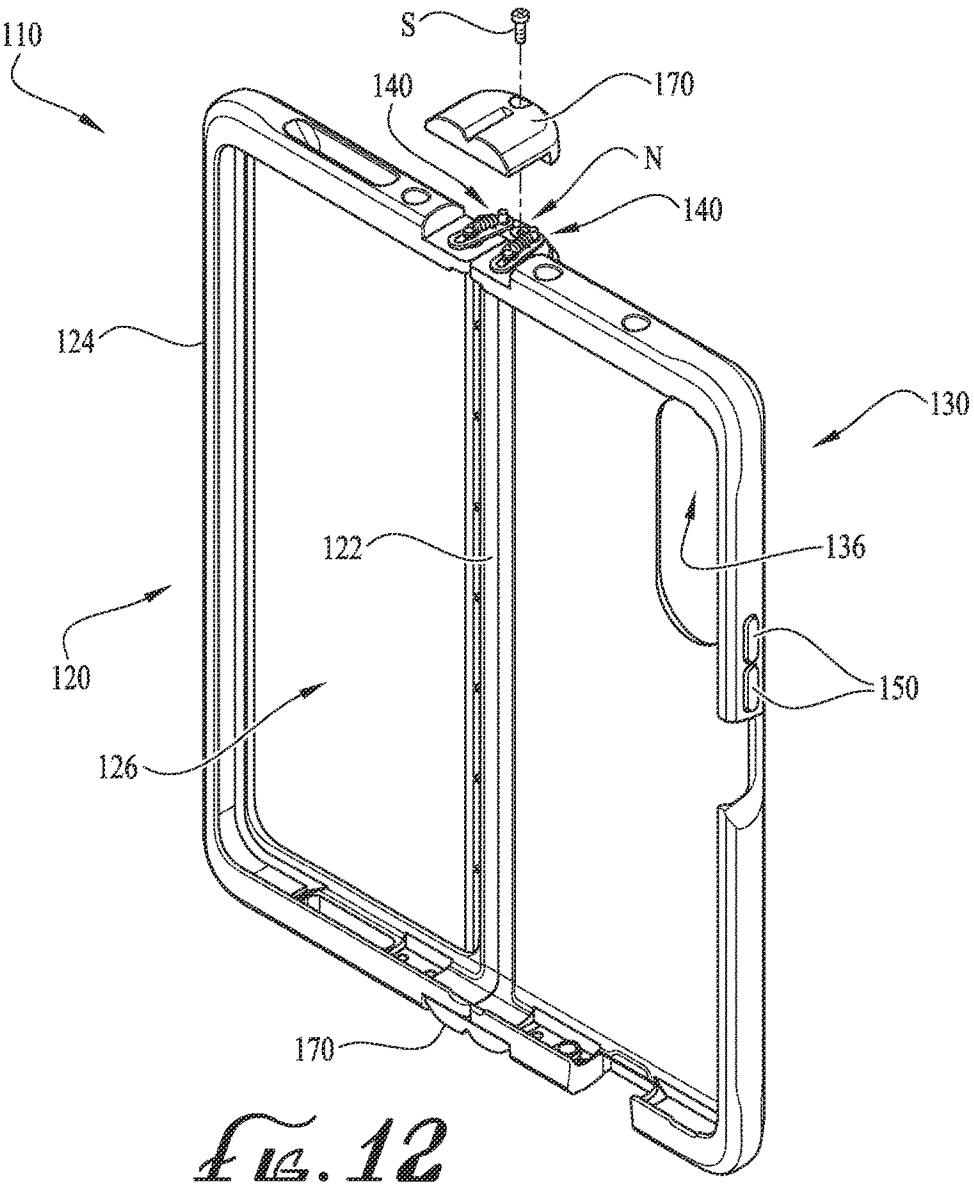
FIG. 12 is a perspective view of the tension spring assisted protective cover or case for a foldable portable electronic device in an open configuration with a top hinged endcap removed, according to another example embodiment of the present invention.

FIGS. 12-13 show a foldable protective case or cover 110 for a foldable portable electronic device, according to another example embodiment of the present invention. In the depicted embodiment, the case or cover 110 includes a housing for receiving and at least partially covering the foldable electronic device. In example embodiments, the case or cover 110 is configured to fit a foldable smart-phone, tablet computer, cell phone, MP3 player, music and/or video player, electronic reader, handheld game device, or other foldable portable electronic device. Case 110 generally comprises a first or front jacket or shell 120, a second or back jacket or shell 130, a hinge cover 160, top and bottom hinge cover endcaps 170, and one or more spring-and-link coupling mechanisms or systems 140 operatively engaged between the front and back shells 120, 130 and the hinge cover 160. In example forms, the front and back shells 120, 130 are at least partially formed of polycarbonate or other hard plastic, metal, composite, polymeric, ceramic, and/or other material(s) of construction.

As shown in FIG. 12, the front shell 120 generally comprises a front plate or base panel 122 and a raised sidewall 124. In the depicted embodiment, the sidewall 124 projects transversely outward along the top edge, the bottom edge, and a first or outer side edge of the base 122, forming a continuous sidewall 124 with a top sidewall portion, a first radiused corner, a first side sidewall portion, a second radiused corner, and a bottom sidewall portion partially bounding an interior chamber for receiving an electronic device. The sidewall 124 preferably comprises a ridge or flange along its perimeter at its distal rim that extends inwards towards the center of the shell 120 to help retain the case on an electronic device. In the depicted embodiment, the front base panel 122 is generally flat and generally rectangular with rounded corners. In example embodiments, the front base panel 122 and sidewall 124 may comprise one or more cutouts or openings adapted to show or allow access to at least a portion of the electronic device, for example, a display screen, controls, ports and/or other user interfaces. In the depicted embodiment, for example, the front shell 120 comprises an opening 126 adapted to show an exterior display screen or surface of the electronic device. The front shell 120 may further comprise additional openings along the top, side and/or bottom edges of sidewall 124 configured to allow access to or operation of various user interfaces or mechanisms and input/output ports (e.g., charging ports, audio cable ports, speakers, microphones, etc.) In alternate embodiments, the front base panel and openings may comprise different configurations or profiles to match the shape or configuration of a particular electronic device for which the case is configured. In yet other embodiments, the sidewall 124 comprises two or more separate sidewalls extending from discrete sections of the base periphery resulting in a plurality of discrete sidewalls.

Figure 14:
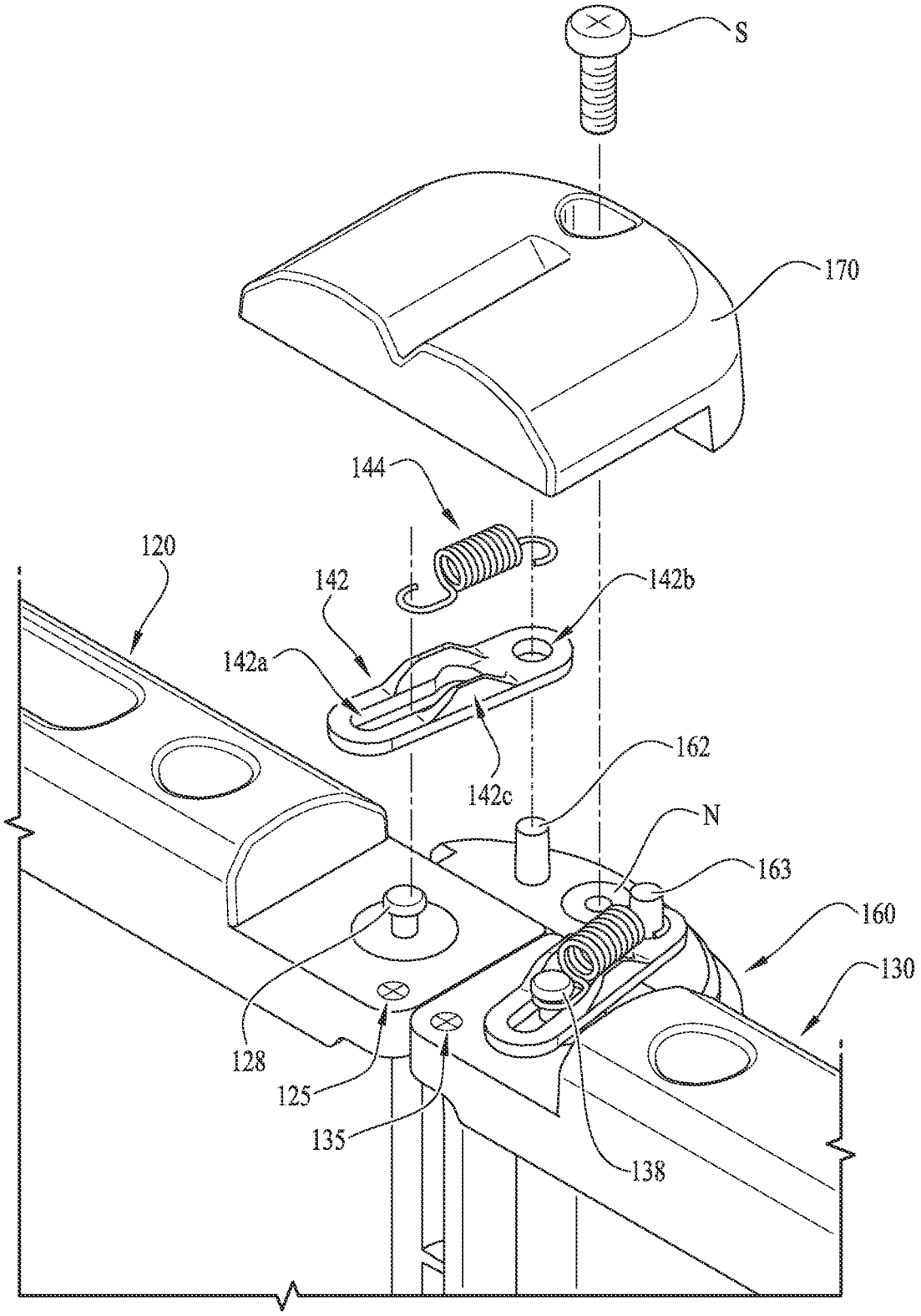
FIG. 14 shows an exploded view of one set of tension spring and hinge link element and an assembled view of another set of tension spring and hinge link element of the tension spring assisted protective cover of FIG. 12.

The front shell 120 further comprises one or more coupling element retainers or retention elements, for example in the form of holding posts or support members 128, as best shown in FIG. 14. In alternate embodiments, the coupling element retainers may be in the form of a recess, projection or other surface feature, and/or a coupling, connector or other attachment means, for coupling a spring and/or other coupling elements to the front shell 120. In the depicted embodiment, one holding post 128 is located on the top sidewall of front shell 120 and extends transversely outward therefrom away from the center of the front shell. A second holding post 128 is located on the bottom sidewall of front shell 120 and extends transversely outward therefrom away from the center of the front shell. The two posts 128 are preferably located near the side of base panel 122 opposite the first side edge (or near the ends of the top and bottom portions of sidewall 124 opposite from the radiused corners). The posts 128 further comprise enlarged heads for retaining or preventing accidental disengagement of spring and/or coupling elements. In other example embodiments, the posts comprise a groove or channel along the perimetric surface (see for example posts 28 in FIG. 4). In the depicted embodiment, posts 128 comprise a cylindrical shape or a circular cross-section; however, the cross-sectional shape of posts 128 can comprise of various geometric shapes, such as for example, rectangle, triangle, star, and the like.

The back shell 130 generally comprises a back plate or base panel 132 and a raised sidewall 134. In the depicted embodiment, the sidewall 134 projects transversely outward along the top edge, the bottom edge, and a first side edge of the base 132, forming a continuous sidewall 134 with a top sidewall portion, a first radiused corner, a first side sidewall portion, a second radiused corner, and a bottom sidewall portion partially bounding an interior chamber for receiving the electronic device. The sidewall 134 preferably comprises a ridge or flange along its perimeter at its distal rim that extends inwards towards the center of the shell 130 to retain the case in place on an electronic device. In the depicted embodiment, back base 132 is generally flat and rectangular with rounded corners. In example embodiments, the back base panel 132 and sidewall 134 may comprise one or more cutouts or openings adapted to show or allow access to at least a portion of the electronic device, for example, a display screen, controls, and/or other user interfaces or ports. In the depicted embodiment, for example, the back shell 130 comprises an opening 136 configured to be aligned with one or more camera lenses on the exterior of the electronic device. The back shell 130 further comprises additional openings along the top, side and/or bottom edges of sidewall 134 configured to allow access to or operation of various user interfaces or mechanisms and input/output ports (e.g., charging ports, audio cable ports, speakers, microphones, etc.) In alternate embodiments, the back base panel and openings may comprise different configurations or profiles to match the shape or configuration of a particular electronic device. In yet other embodiments, the sidewall 134 comprises two or more separate sidewalls extending from discrete sections of the base periphery resulting in a plurality of discrete sidewalls.

The front shell 130 further comprises one or more coupling element retainers or retention elements, for example in the form of holding posts or support members 138, as best shown in FIG. 14. In alternate embodiments, the coupling element retainers may be in the form of a recess, projection or other surface feature, and/or a coupling, connector or other attachment means, for coupling a spring and/or other coupling elements to the front shell 130. In the depicted embodiment, one holding post 138 is located on the top sidewall of back shell 130 and extends transversely outward therefrom away from the center of the back shell. A second holding post 138 is located on the bottom sidewall of jacket 130 and extends transversely outward therefrom away from the center of the back shell. The two posts 138 are preferably located near the side of base panel 132 opposite the first side edge (or near the ends of the top and bottom portions of sidewall 134 opposite from the radiused corners). The posts 138 further comprise enlarged heads for retaining or preventing accidental disengagement of spring and/or coupling elements. In other example embodiments, the posts comprise a groove or channel along the perimetric surface (see for example posts 28 in FIG. 4). In the depicted embodiment, the posts 138 comprise a cylindrical shape or a circular cross-section; however, the cross-sectional shape of posts 138 can comprise of various geometric shapes, such as for example, rectangle, triangle, star, and the like.

The front and/or back shells 120, 130 can additionally include one or more buttons 150 positioned in the cutouts of the shells, as shown in FIG. 12, wherein the buttons 150 are configured to engage buttons on the device such as the volume controls and power button. The buttons 150 can include a T-shaped retaining feature configured to engage a flange on the front and back shells to keep the buttons 150 engaged with the shells. In the example embodiments, buttons 150 are formed of polycarbonate or other injection molded material.

In example embodiments, the case 110 further comprises a hinge cover or shell 160, as shown in FIG. 13. According to example embodiments, the hinge cover 160 generally comprises an elongate channel-like or semi-tubular structure extending from a top end to a bottom end. In example embodiments, the top and bottom ends of the hinge cover 160 are closed comprising a short transverse wall generally perpendicular to the axis of elongation of the hinge cover. In the depicted embodiment, the hinge cover 160 comprises a generally arcuate cross-section, but other cross-sectional profiles and shapes may be used. The hinge cover 160 further comprises a plurality of coupling element retainers or retention elements, for example in the form of holding posts or support members 162 and 163, as shown in FIG. 14. In alternate embodiments, the coupling element retainers may be in the form of a recess, projection or other surface feature, and/or a coupling, connector or other attachment means, for coupling a spring and/or other coupling elements to hinge cover 160. In the depicted embodiment, a first pair of holding posts 162, 163 is located on the top end of hinge cover 160 and extends in a direction opposite the bottom end. A second pair of holding posts 162, 163 is located on the bottom end of hinge cover 160 and extends in a direction opposite the top end. In some example embodiments, holding posts 162, 163 are provided on only one end of the hinge cover and a hinge component is secured to the other end.

In example embodiments, holding posts 162 and 163 on the top end of the hinge cover 160 are generally co-planarly aligned to the top holding post 128 of front shell 120 and top holding post 138 of the back shell 130, respectively. Similarly, holding posts 162 and 163 on the bottom end of the hinge cover 160 are generally co-planarly aligned to the bottom holding post 128 of front shell 120 and bottom holding post 138 of the back shell 130, respectively. In example embodiments, hinge cover tops or endcaps 170 are provided and configured to be secured to the top and bottom ends of the hinge cover 160. When secured to the hinge cover, the hinge cover endcaps 170 help prevent the coupling elements from becoming accidentally detached from the holding posts, and also shields against user contact with the coupling elements and at potential pinch points between the shells and hinge cover. In example embodiments, hinge cover 160 further comprises a threaded bore on each end of the hinge cover which are adapted for receiving reciprocally threaded bolts or screws S used to secure the hinge cover endcaps 170 to the hinge cover 160. In the depicted embodiment, threaded bores are provided by means of threaded rivet nuts N. In alternate embodiments, the hinge cover end caps 170 may be configured for removable engagement with hinge cover 160 by means of push-fit, friction fit, snap fit, adhesives, hook-and-loop fasteners or other suitable fastening or securing means.

As shown in FIGS. 12-14, a plurality of coupling elements or engagement means 140 are installed on the case 110 to pivotally secure the front and back shells 120, 130 to the hinge cover 160. Particularly, FIG. 14 shows a detail view of a first set of coupling mechanisms secured to the holding post 138 of the back shell 130 and holding post 163 on the top end of the hinge cover 160. FIG. 14 also shows an exploded view of a second set of coupling mechanisms aligned to the holding post 128 of the front shell 120 and holding post 162 on the top end of the hinge cover 160. In example embodiments, each of the sets of coupling elements 140 comprises a link or linkage element 142 and a biasing element or springs 144.

In example embodiments, link 142 is generally a flat, elongate crosspiece or strip comprising an oblong or elongate aperture 142*a* at its first, proximal end and a round aperture 142*b* at its second, distal end. Generally, the oblong aperture 142*a* is configured for a pin-in-slot joint or engagement with holding post 128 or 138 which provides an additional degree-of-freedom to the movement of the front and back shells 120, 130 in comparison to a pin joint configuration. For example, if the link 142 comprised round apertures at both ends, movement of the holding post 128, and thus front shell 120, relative to holding post 162 of hinge cover 160 would be fixed to a substantially constant radius from holding post 162. However, the oblong or elongate aperture 142*a* provides an additional degree of freedom in the radial direction between the holding posts 128, 138 and holding post 162, 163 to accommodate the rotation or pivot of the front and back shells 120, 130 around their corners. In example embodiments, link 142 also comprises a pair of raised ridges or fingers 142*c* adapted for receiving and supporting the tension spring 144. In the depicted embodiment, the raised ridges 142*c* include curved or arcuate inner surfaces configured to generally conform to the exterior surface of the biasing element or spring 144. The curved inner surfaces of the ridges 142*c* provide support and help retain the spring 144 directly over the link 142 to further ensure the two coupling element components move or operate in tandem. In alternate embodiments, the link 142 and spring 144 may incorporate alternate arrangements and configurations. For example, in an alternate embodiment, the link 142 may comprise a tubular structure configured to receive and retain a spring therein. In yet another example embodiment, the spring may be positioned below the link. In still another example embodiment, the coupling element may comprise either only a link made at least in part from elastic material(s) or only a spring.

In example embodiments, the front shell 120 is connected to the hinge cover 160 by securing the first distal ends of first link and spring elements 142, 144 to one support post 128 on the front shell 120 and securing the second distal ends of the link and spring elements 142, 144 to the support post 162 on the hinge cover 160. The back shell 130 is connected to the hinge cover 160 by securing the first distal ends of second link and spring elements 142, 144 to one support post 138 on the back shell 130 and securing the second distal ends of the second link and spring elements 142, 144 to the support post 163 on the hinge cover 160. In a similar manner, third and fourth link and spring elements are secured to holding posts 128, 138, 162 and 163 connecting the bottom sidewalls of the front and back shells 120, 130 to the bottom end of the hinge cover 160. In the depicted embodiments, the biasing elements or springs 144 are tension springs, as shown in FIG. 14. The first and second distal ends of the tension springs comprise engagement features in the form of a loop or ring. In alternate embodiments, the biasing elements or engagement means may comprise an elastic cord, band, strip, living hinge and/or other elastically resilient member, a helical, coil, torsion, leaf or other form of extension or compression spring, one or more magnetic and/or magnetically-attracted elements, a gravity-assisted or manual closure mechanism, and/or other form of biasing or engagement means. In yet other embodiments, engagement features are in the form of hooks and/or clips. In further alternate embodiments, the ends of the spring or other tension member engage within recesses or other retention elements or engagement features on the front and back shells, or are secured by adhesive, fasteners or other attachment means. In alternate embodiments, a single pair of coupling mechanisms 140 may be provided at either the top or the bottom of the case 110 while a pivotal hinge mechanism is provided at the other, opposite end of the case.

In use, the user installs the case 110 onto a foldable electronic device having a first housing and a second housing, where the first housing and the second housing are connected by a hinge element. The user installs the front shell 120 onto the device's first housing and the back shell 130 onto the second housing of the device. In an example method of use, the first housing of a foldable electronic device is inserted into front shell 120 such that the exterior of the first housing fits snugly within the sidewall 124 and front panel 122. The flange of sidewall 124 helps retain the device within shell 120. Similarly, the second housing of the device is inserted into the back shell 130 such that the exterior of the second housing fits snugly between sidewall 134 and back panel 132, and the second housing is further retained by the flange of sidewall 134. The hinge or fulcrum geometry of the case 110 generally corresponds to the hinge or fulcrum geometry of the folding electronic device intended to be housed in the case, whereby the relative pivotal or folding movement of the case shells 120, 130 substantially matches the relative pivotal or folding movement of the corresponding folding elements of the device for smooth operation and closely conforming fit.

In example embodiments, a foldable electronic device is generally capable of pivotal movement through a range of motion including the depicted four relative positions—fully closed, semi-closed, semi-open, and fully open—as shown in FIGS. 15A-D. FIGS. 15A-D further show detail views of link and spring mechanism 142, 144 in the four positions, and depict a sequence of opening (FIGS. 15A to 15D) and closing (FIGS. 15D to 15A) the device within the case or cover 110 according to example methods of use.

Figure 15B:
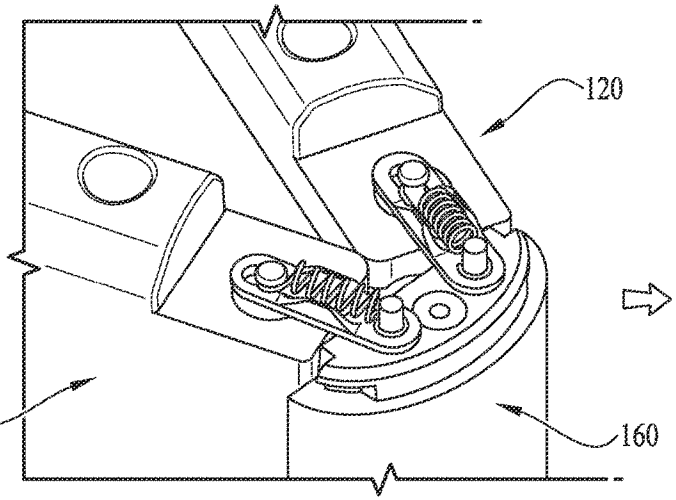
FIGS. 15A-15D show a sequence of operation of the cover of FIG. 12 according to another example embodiment, moving from a closed configuration to an open configuration.
Figure 15A:
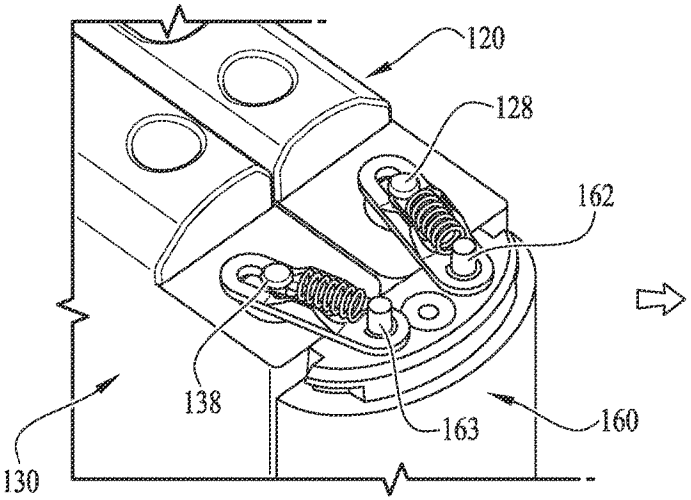

In an example method of use, springs 144 are under tension when the case and electronic device are in a fully closed position (FIG. 15A). The tensional load on springs 144 bias the case 110 toward the fully closed position and resists external forces to spread apart the front and back shells 120, 130 rotationally about a fulcrum point fixed by the device's hinge. As the user applies greater force and overcomes the resistance, the front and back shells 120, 130 spread apart about the device's hinge. As the angle between the front and back shells 120, 130 increase (FIGS. 15B and 15C), the distances between the holding posts 128, 138 and holding posts 162, 163 increase as corners of the front and back shells interact with the hinge cover and one another to pivot about fulcrum points 125, 135. In turn, the tension in the springs 144 increase during the pivoting motion and the springs bias the shells to either the fully open or fully closed positions where the springs are closest to their neutral state. The tension in the springs also pull the front and back shells 120, 130 towards the hinge cover 160 such that the hinge cover is in contact with at least portions of both the front and back shells during operation. For example, as shown in FIGS. 15A-15D, as the front and back shells 120, 130 are rotated or pivoted between the closed and open positions, at least portions of the sides of the front and back shells adjacent the hinge cover 160 slide or move along an interior surface of the hinge cover 9 (e.g., the flat surface of hinge cover shown in FIGS. 15A-15D).

Figure 15D:
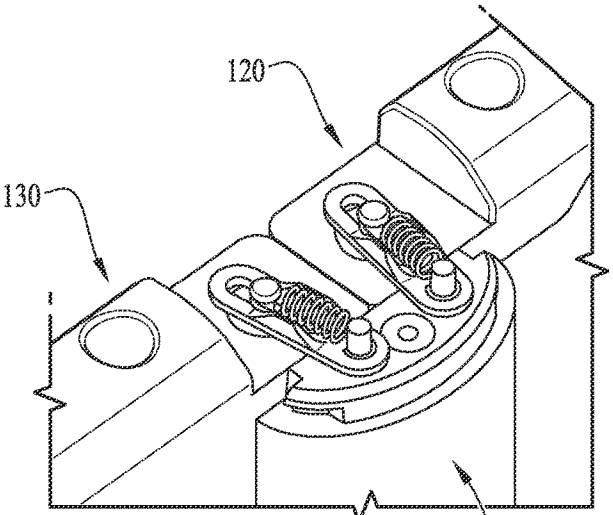
Figure 15C:
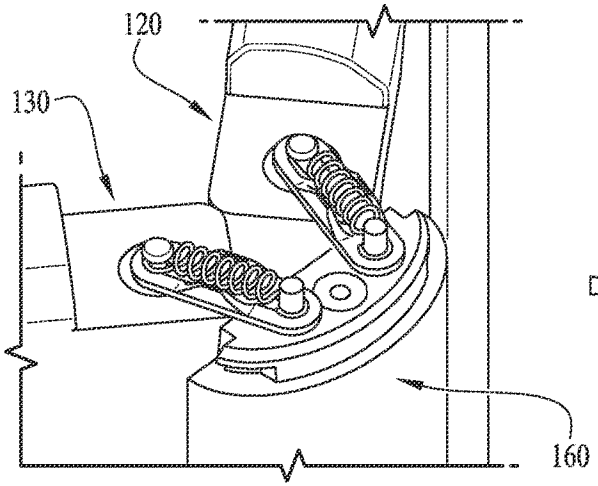

In a fully open position, as shown in FIG. 14, the fulcrum points 125 and 135 of the shells 120 and 130, respectively, are at their farthest position from the hinge cover 160. Conversely, in a fully closed position, the fulcrum points 125 and 135 are at their closest position to the hinge cover. As the shells rotate or pivot relative to one another along an opening and/or closing range of motion constrained by the device's coupling elements 140, the fulcrum points move along a line of motion between the position of the fulcrum points at the fully open and fully closed states. A semi-closed position refers to any configuration of case 110 where the fulcrum points 125 and 135 are between the fulcrum points' positions at the fully closed state and the middle point along the line of motion between the fully open and closed states. In a semi-closed position, the tension in the spring will cause rotation of the top and bottom shells to return the case to a fully closed position (FIG. 15B to FIG. 15A). A semi-open position refers to any configuration of case 110 where the fulcrum points 125 and 135 are between the middle point along the line of motion between the fully open and closed states and the fulcrum points' positions at the fully open state. In a semi-open position, the tension in the spring will apply a force to both top and bottom shells causing rotation about their respective fulcrum points 25, 35 to bias the device toward the fully open position (FIG. 15C to FIG. 15D).

In example embodiments, the front and back shells 120, 130, hinge cover 160, hinge cover endcaps 170 and links 142 can be formed from polycarbonate or other hard plastics, thermoplastic polyurethane or other soft plastics, metal, composite, ceramic, and/or other material(s) of construction. In particular embodiments, the front and back shells, hinge cover and hinge cover endcaps optionally comprise hard and durable outer shells for impact resistance, for example comprising polycarbonate (PC) or other hard plastic, and softer cushioning inner layers or linings, for example comprising thermoplastic polyurethane (TPU) for shock absorption, to provide improved protection to the electronic device housed in the case. In further example embodiments, the case optionally also comprises an inner frame or wall that conforms to the inner surfaces of sidewalls 124 and 134. The inner frame preferably comprises a resilient or compressible material such as foam, silicon, rubber, elastomer or the like, to cushion the electronic device from impacts and assist in retaining the case or cover in place on an electronic device contained therein.

While the invention has been described with reference to example embodiments, it will be understood by those skilled in the art that a variety of modifications, additions and deletions are within the scope of the invention, as defined by the following claims.

What is claimed is:

1. A foldable case for housing a foldable electronic device therein, the case comprising a first shell, a second shell and a hinge cover, the first and second shells being connected to the hinge cover by a plurality of coupling mechanisms, wherein the plurality of coupling mechanisms retain the first and second shells operatively engaged with the hinge cover to allow a pivotal folding movement therebetween upon opening and closing of the device housed in the case, wherein the case further comprises at least one hinge cover endcap secured to at least one end of the hinge cover.

2. The foldable case of claim 1, wherein each of the plurality of coupling mechanisms comprises a biasing element and a link element.

3. The foldable case of claim 2, wherein the biasing element is a spring.

4. The foldable case of claim 2, wherein the link element comprises an oblong aperture at a first end and a round aperture at a second end opposite the first end, the oblong aperture being adapted for pin-in-slot joint engagement and the round aperture being adapted for pin joint engagement.

5. The foldable case of claim 1, wherein the plurality of coupling mechanisms bias the first and second shells toward an open configuration when the case is partially open, and bias the first and second shells toward a closed position when the case is partially closed.

6. A case for a foldable electronic device, the case comprising:

a first shell comprising a first back panel and a first peripheral frame extending at least partially around the first back panel, and further comprising a first retention element positioned on the first peripheral frame;

a second shell comprising a second back panel and a second peripheral frame extending at least partially around the second back panel, and further comprising a second retention element positioned on the second peripheral frame;

a third shell comprising an elongate body with a first end and a second end, and further comprising a pair of retention elements including a third and a fourth retention element on one of its first or second ends; and a first tension coupling mechanism connected between the first retention element and the third retention element, and a second tension coupling mechanism connected between the second retention element and the fourth retention element, wherein the coupling mechanisms retain the first and second shells in operative engagement with the third shell as the first and second shells move through a range of motion between an open configuration and a closed configuration.

7. The case of claim 6, wherein at least one of the first and second shells comprise a hard plastic portion and a soft plastic portion.

8. The case of claim 6, further comprising at least one case button, wherein the case button is operably aligned with a user input actuator of the electronic device when the case is installed on the device.

9. The case of claim 6, further comprising at least one endcap configured for engagement with the third shell over the tension coupling mechanisms.

10. The case of claim 6, wherein the tension coupling mechanisms comprise a spring.

11. The case of claim 6, wherein the tension coupling mechanisms comprise an elastic band.

12. The case of claim 6, wherein the tension coupling mechanisms comprise a linkage element having a flat elongate body with an oblong aperture at a first end and a round aperture at a second end opposite the first end.

13. The case of claim 6, wherein the tension coupling mechanisms retaining the first and second shells in operative engagement with the third shell comprise at least one pin-in-slot joint and at least one pin joint.

14. The case of claim 6, wherein the first, second and third retention elements comprise holding posts protruding from the first, second and third shells, respectively, and wherein each of the holding posts are configured for cooperative engagement with at least one tension coupling mechanism.

15. The case of claim 6, wherein the front shell and the back shell define one or more apertures positioned to align with corresponding features of the electronic device.

16. A foldable case for at least partially housing a foldable electronic device, the foldable electronic device having a first device portion, a second device portion, and a hinged device coupling between the first and second device portions allowing a pivotal range of motion between the first and second device portions, the foldable case comprising:

a first case portion configured to at least partially house the first device portion when the case is installed on the device;

a second case portion configured to at least partially house the second device portion when the case is installed on the device;

a third case portion configured to at least partially house the hinged device coupling when the case is installed on the device; and engagement means between the first and second case portions and the third case portion, wherein the engagement means maintains a biasing force between the first and second case portions and retains the first and second case portions in operative engagement with the third case portion through the pivotal range of motion when the case is installed on the device, wherein at least sections of the first and second case portions are in contact with the third case portion throughout the pivotal range of motion.

17. The foldable case of claim 16, wherein the engagement means comprises at least one spring retained in tension between the first case and second case portions and the third case portion when the case is installed on the device.

18. The foldable case of claim 17, wherein the engagement means comprises link elements constraining movements of the first case and second case portions relative to the third case portion.

* * * * *